US006935325B1

(12) United States Patent
Getty

(10) Patent No.: US 6,935,325 B1
(45) Date of Patent: Aug. 30, 2005

(54) METHOD AND APPARATUS FOR CUTTING AND POLISHING STONE ARTICLES

(76) Inventor: Lawrence L. Getty, 519 Hartford Rd., Salem, CT (US) 06420

( * ) Notice: Subject to any disclaimer, the term of this patent is extended or adjusted under 35 U.S.C. 154(b) by 0 days.

(21) Appl. No.: 10/697,921

(22) Filed: Oct. 30, 2003

Related U.S. Application Data

(60) Provisional application No. 60/423,629, filed on Nov. 1, 2002.

(51) Int. Cl.[7] ..... B28D 1/02
(52) U.S. Cl. ..... 125/20
(58) Field of Search ..... 125/20, 23.01; 175/403, 404, 405, 405.1

(56) References Cited

U.S. PATENT DOCUMENTS 2,874,688 A 2/1959 Biesanz et al.
4,625,707 A * 12/1986 Whittaker ..... 125/20
4,652,185 A * 3/1987 Malrick ..... 408/68
5,069,584 A * 12/1991 Obermeier et al. ..... 408/145
5,638,805 A 6/1997 Li
5,996,571 A 12/1999 Jedick

* cited by examiner

*Primary Examiner*—Dung Van Nguyen
(74) *Attorney, Agent, or Firm*—Bachman & LaPointe, P.C.

(57) ABSTRACT

A method for making a stone article includes the steps of providing a block of material having substantially square top and bottom surfaces, impacting the top and bottom surfaces with a non-square blade so as to split off-excess material from the top and bottom surfaces and provide said surfaces with a shape substantially matching the non-square blade cutting a cylindrical cut into said top surface, drilling a hole into the bottom surface, and applying a force into the hole whereby a stone portion within the cylindrical cut is removed from the block of material. A stone polishing apparatus is also provided.

9 Claims, 4 Drawing Sheets

METHOD AND APPARATUS FOR CUTTING AND POLISHING STONE ARTICLES

CROSS REFERENCE TO RELATED APPLICATION

This application is a continuation-in-part of co-pending application Ser. No. 60/423,629 filed Nov. 1, 2002.

BACKGROUND OF THE INVENTION

The invention relates to stone cutting and polishing and, more particularly, to methods for cutting stone to produce useful articles such as planters, vases and the like, and to methods and an apparatus for polishing certain surfaces of same.

Stone planters and vases are decorative articles for which there is a demand. Such articles are frequently made from stone, especially granite.

Starting granite raw material for such articles is typically in the form of a square or a substantially rectangular block of granite. In the course of providing a planter or vase from such an article, a rounded outer appearance and a hollow center section are typically desired. Conventional methods for providing such structures are time consuming. Furthermore, following conventional methods, the central portion removed from the block to form the planter or vase is typically destroyed and/or wasted.

It is clear that the need remains for improved methods for providing articles such as planters and vases from substantially square or rectangular blocks of stone, especially granite. It is therefore the primary object of the present invention to provide such methods.

It is a further object of the present invention to provide such a method wherein far less starting material is wasted.

It is still another object of the present invention to provide a method and apparatus for polishing the outside surface of cylindrical or accurate outer-shaped stone articles to enhance the appearance of same.

SUMMARY OF THE INVENTION

In accordance with the present invention, the foregoing objects and advantages have been readily attained.

According to the invention, methods are provided for providing an rounded outer surface on a substantially rectangular or square block of stone such as granite, for removing a substantially cylindrical central portion from the block of granite, for removing a smaller substantially cylindrical portion from the originally removed cylindrical portion so as to provide yet another useful article such as a planter or vase, and for polishing the cylindrical outer surfaces of central portions removed in the course of these methods.

These methods and apparatus advantageously provide for simpler and faster provision of the original planter or vase to be provided from the starting material, and also provide for the fabrication of useful and desirable articles from the central portions removed such that very little starting material is wasted, particularly as compared to conventional processes.

BRIEF DESCRIPTION OF THE DRAWINGS

A detailed description of preferred embodiments of the present invention follows, with reference to the attached drawings, wherein.

DETAILED DESCRIPTION

The invention relates to stone cutting methods and, more particularly, to a method for treating a block of granite so as to form rounded outer surfaces on the block, and so as to remove a substantially cylindrical-shaped central portion from the block, so as to provide a planter or vase or other useful articles as desired.

Furthermore, the invention is drawn to methods for polishing the outer cylindrical surface of the central portion so removed, and/or for removing a smaller central portion from the originally removed central portion so as to provide a further planter, vase or the like, and this method can be repeated until the removed central portion is too small to be of any use. In this manner, and advantageously, a plurality of useful articles are provided from a single block of granite, each of which is appealing to consumers, far less material is wasted, and the resulting products are provided in a simpler, less time-consuming and more cost-effective manner.

Figure 1:
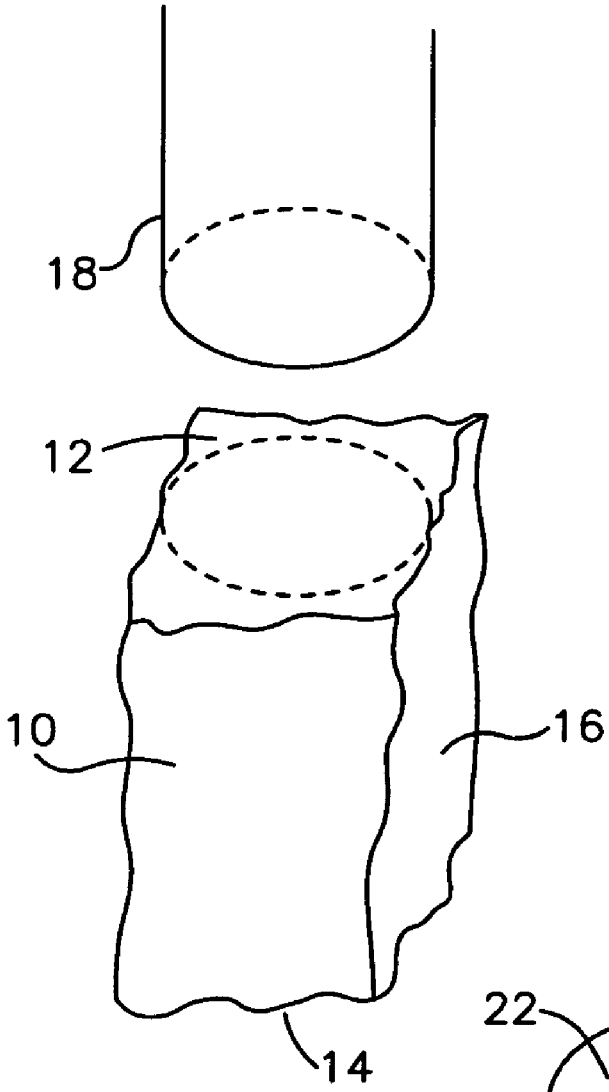
FIG. 1 illustrates an initial step of the present invention wherein corners are removed from a square block of material.

FIG. 1 shows a block of granite 10 in substantially rectangular form having a top surface 12, a bottom surface 14 and sides 16. A typical size for such a block of granite to be used in accordance with the present invention would be between about 5 and about 14 inches in height and between about 2 and about 12 inches in width. Of course, other size blocks of granite can be used as starting material as well.

In many applications, the first step is to provide rounded top and bottom surfaces, and conventionally this is done through various manual procedures and is very time consuming.

In accordance with the present invention, it has been found that a rounded top 12 and rounded bottom 14 can be provided by impacting or pressuring surfaces 12, 14 with a blade having the desired shape, typically a round cross section to provide a rounded top, and it has been found advantageously that impacting surface 12 with a blade 18 such as is shown in FIG. 1 advantageously serves to split away corners of the block as desired.

Figure 2:
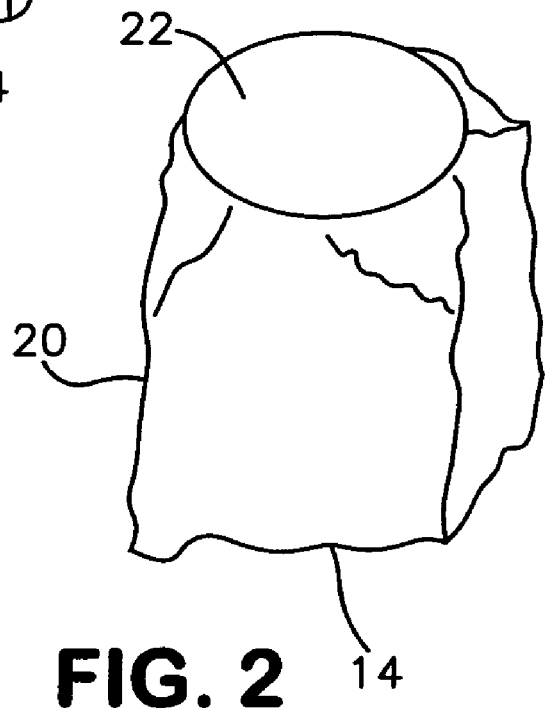
FIG. 2 illustrates the resulting product of the step illustrated in FIG. 1.

In accordance with the present invention blade 18 can advantageously be a hardened carbide or steel pipe or other structure, preferably provided having a hardened and/or sharpened end. This advantageously pressure-splits the top corner edges off of top surface 12 to provide a block 20 (FIG. 2) having a rounded top surface 22.

In accordance with the invention, block 20 can then be flipped over and the same process performed on bottom surface 14 as desired. Alternatively, block 10 from FIG. 1 can be treated on both top and bottom surfaces 12, 14 with two blades 18 so as to provide rounded top and bottom surfaces substantially simultaneously.

In accordance with a further aspect of the present invention, a method is provided for removing a substantially cylindrical center portion of the block of granite so as to provide an article suitable for use as a planter, vase and the like.

Figure 3:
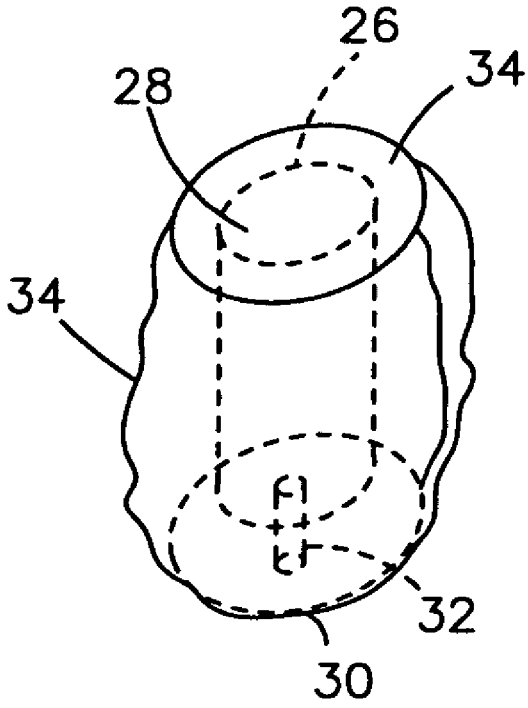
FIG. 3 illustrates a block of material with the corners having been removed and having a core drilled into one side and a hole drilled into the other side.

FIG. 3 shows a starting block of material 24 with the cylindrical centerpiece 26 marked in dashed lines. This cylindrical centerpiece 26 is to be removed from block 24 in accordance with the present invention.

Conventionally, centerpiece portion 26 would be removed through chiseling, grinding and other time-consuming processes which also would tend to destroy the actual portion being removed. In accordance with the present invention, portion 26 is removed by first cutting a cylindrical cut into top surface 28 of block 24 and to a desired depth within block 24. This cut can be formed using a stone core drill or the like, and is advantageously made in the direction of the grain or rift of the block. The depth of the cut is preferably made to within about 0.5 and about 1.5 inches of bottom surface 30 of block 24. A hole 32 is then drilled into bottom surface 30 of block 24 preferably having a diameter of between about 0.5 and about 1 inches, and preferably in the center of bottom surface 30 substantially as shown. This hole is preferably drilled to a depth of between about 0.5 and about 1.5 inches, and further preferably to approximately the same depth as a distance between the end of the cylindrical cut from face 28 and surface 30. Hole 32 may be drilled prior to the cylindrical cut as well.

Block 24 is then advantageously supported, preferably around edges 34 of top surface 28, and a shaft or other suitable member is positioned in hole 32 to which pressure or an impact are applied. This can be done with a hydraulic press and/or a large hammer or any other suitable device, and this impact or pressure advantageously serves to fracture off the bottom portion of central portion 26 from the remainder of block 24 and drives central portion 26 out of block 24, against the grain of the material, so as to provide a final article having a hollowed central portion which is suitable for use as a planter, wine cooler, lamp, vase and the like.

Figure 4:
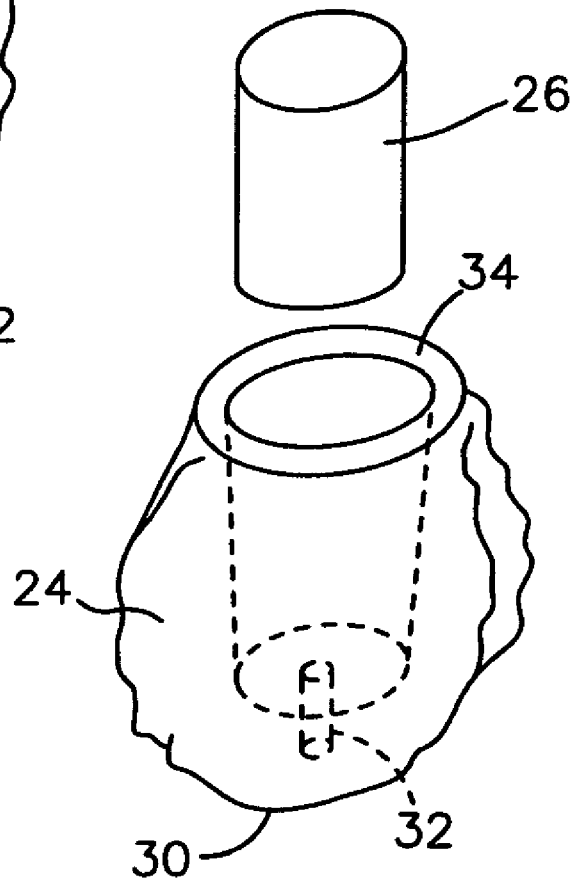
FIG. 4 illustrates removal of the central core from the block of material of FIG. 3.

It should be appreciated that this method provides the final article as illustrated in FIG. 4 in a far less time consuming manner than conventionally can be accomplished. Furthermore, this method provides central portion 26 in a substantially cylindrical and intact form, and this material itself can be used to provide further articles.

Figure 4A:
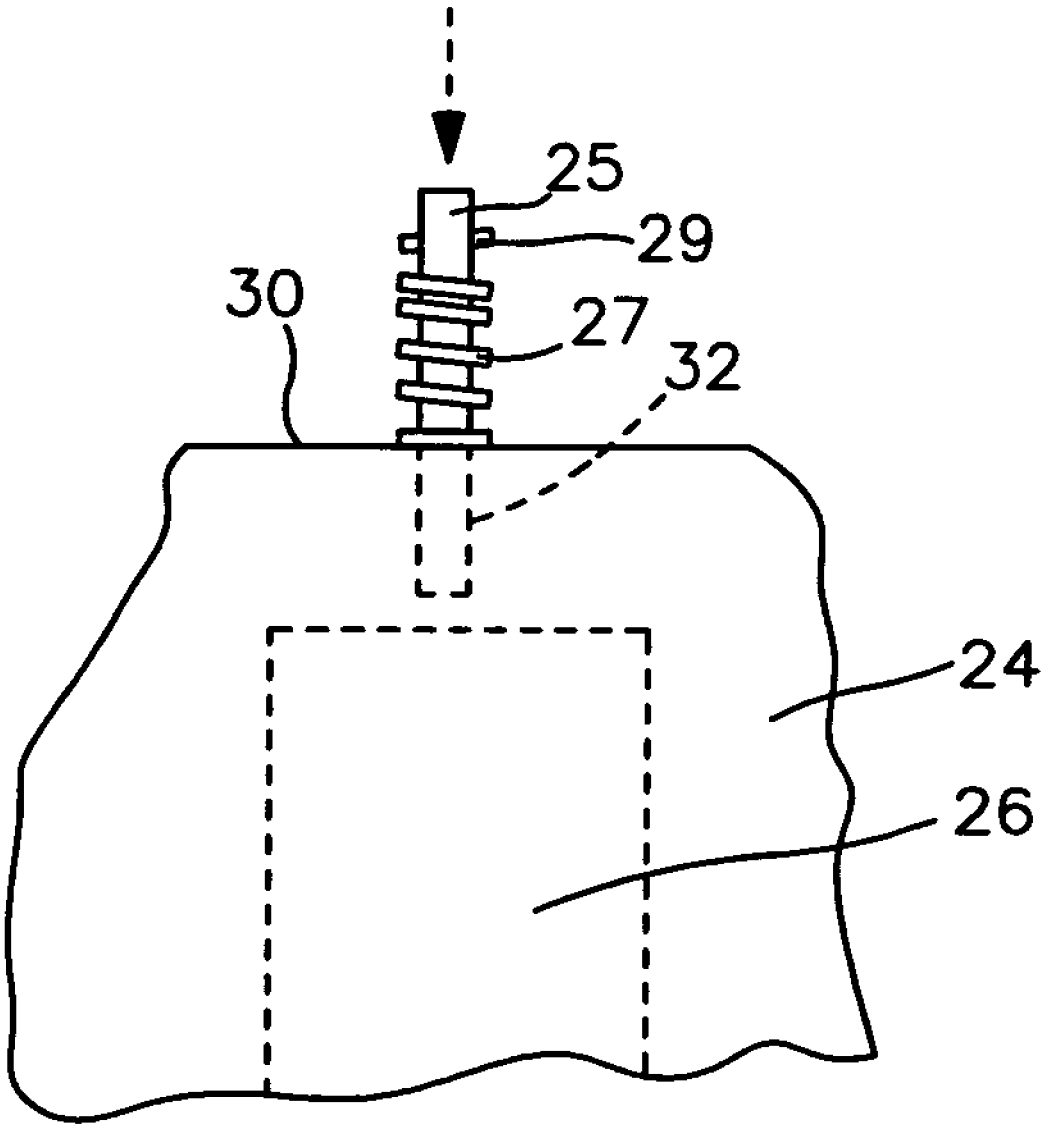
FIG. 4A is a side view illustrating a further aspect of the step of removing the core from the block.

FIG. 4A illustrates a preferred embodiment of the pressure or impacting step which is utilized to remove the cylindrical portion 26 from block 24. As shown in FIG. 4A, shaft 25 which is to be used to impact the base of hole 32 is advantageously provided with a surrounding shock-absorbing member such as a spring 27. When shaft 25 is positioned within hole 32, spring 27 is compressed between a cuff 29 on shaft 25 and the bottom surface 30 of block 24. This biasing or spring member advantageously serves to absorb much of the shock which typically occurs when cylindrical portion 26 fractures free of the remainder of block 24. This is particularly desirable since, without spring 27, block 24 can be violently moved upon fracturing out of central portion 26 which can result in undesirable chips or fractures of different edges of block 24. Thus, in accordance with a preferred embodiment of the present invention, spring or other impact-absorbing means 27 is provided between affixed portion of shaft 25 and the surface of block 24 to absorb this shock as described above.

Figure 5:
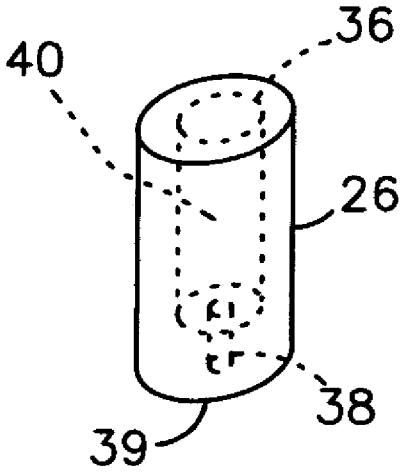
FIG. 5 illustrates further treatment of the core material removed in FIG. 4.

Turning to FIG. 5, central or centerpiece portion 26 itself can then be treated to provide a cylindrical cut 36, and a hole 38 can be drilled from the bottom surface 39 of centerpiece portion 26, and centerpiece portion 40 can thereby advantageously be removed following the same procedure as described above in connection with FIGS. 3 and 4. This procedure can be repeated as many times as are allowed by the decreasing size of the central portion removed from each successive piece of granite. In this manner, many articles can be prepared from the original piece of material, with far less waste.

It should be appreciated that the original article formed, as shown in FIG. 4, has a rough exterior surface with natural finish, which is desirable to consumers. It should also be appreciated that the products fabricated from removed cylindrical portions, or second, third, etc. generation products, have a substantially smooth cylindrical outside surface which can advantageously be flame finished, polished or sand blasted so as to provide them with a decorative and desirable finish.

Figure 6:
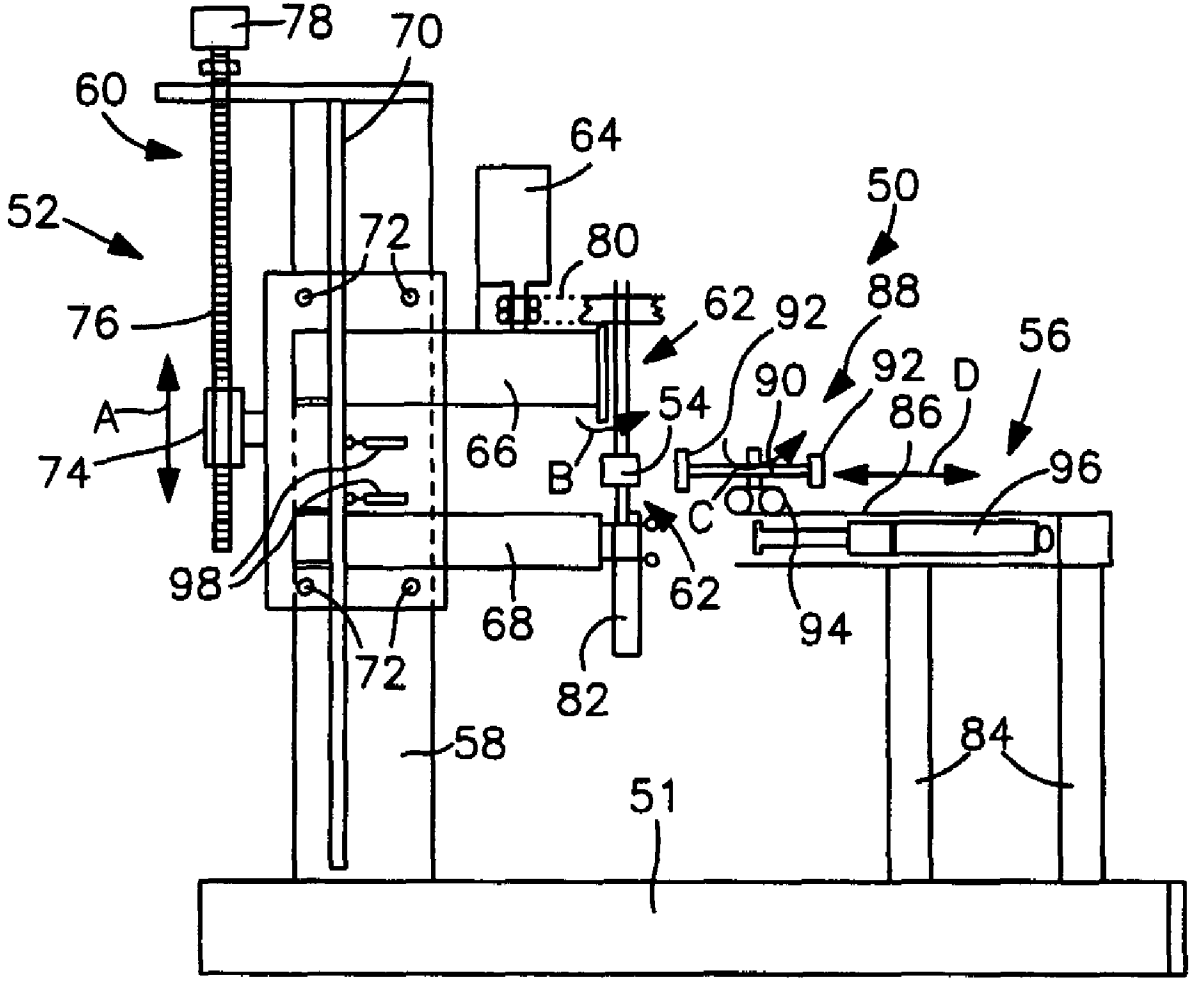
FIG. 6 illustrates an apparatus for polishing outer cylindrical surfaces of a stone object in accordance with the present invention.

Turning now to FIG. 6, an apparatus 50 in accordance with the present invention is illustrated. According to the invention, apparatus 50 has two main portions or assemblies. The first is the workpiece holding and moving assembly 52 which is advantageously adapted to hold a workpiece such as a cylindrical piece of granite 54 to be polished, and for moving workpiece 54 up and down as required, and also for rotating workpiece 54. The second main assembly of apparatus 50 in accordance with the present invention is a polishing head assembly 56 which advantageously serves to rotate different bricks or diamond pads or other type of polishing media, typically having different coarseness or grit, against workpiece 54.

As shown in FIG. 6, assembly 52 may advantageously include a base portion 58, and assembly 60 for providing vertical motion, and holding members 62 adapted to releasably hold workpiece 54 in a rotatable fashion. With these components, workpiece 54 can be mounted between elements 62 and vertically positioned through assembly 60, while simultaneously being rotated around a vertical axis by rotation of elements 62. To this end, a motor such as a 10 HP variable speed motor 64 can advantageously be communicated or operatively associated with element 62 to rotate same, and this motor may advantageously be mounted on a substantially horizontal brace 66 which may also advantageously serve to rotatably support one element 62 for holding workpiece 54 as discussed above.

A further horizontal member 68 is provided, substantially parallel to horizontal member 66, and rotatably supports the other element 62 for holding workpiece 54. Horizontal members 66, 68 are advantageously vertically slidably mounted relative to guide members 70, 72, and are operatively associated with a threaded sleeve 74 which is preferably engaged with a threaded rod 76 which is driven by a motor 78 such as a 1½ HP motor, typically through a gear reducer such as a 60 XI gear reducer, for rotating threaded rod 76 within sleeve 74 so as to move horizontal support members 66, 68 vertically relative to support members 70, 72.

It should be appreciated that motor 64 can advantageously be associated with elements 62 for driving same through a pulley assembly 80 as illustrated, or through any other suitable mechanism.

Furthermore, an air cylinder 82 may advantageously be provided for holding lower element 62 relative to workpiece 54 and allowing for opening of elements 62 relative to each other for placement and removal of workpiece 54 as desired.

Cylinder 82 in accordance with the present invention serves to apply pressure to hold workpiece 54 in place during rotation and vertical movement.

Assembly 56 advantageously includes a base or support member, in this case legs 84, which support a horizontal frame member 86. A polishing head 88 is provided, preferably in the form of a rotatable disc 90 rotatably mounted relative to surface 86 and having positioned thereon a plurality of sanding elements, typically bricks or diamond pads having different coarseness or grit.

In accordance with the present invention, it is preferred to provide five different bricks 92 or sanding elements, positioned around the periphery of disc 90, for use in providing all phases of polishing as are desired. In this regard, a further motor 94 may advantageously be provided for driving rotation of disc 90 relative to surface 86 and thereby for positioning a desired sanding element or brick 92 relative to workpiece 54. This motor may advantageously be a ½ HP motor preferably having a box/gear reducer adapted for providing the desired turning to each brick position.

A further air cylinder 96 is also preferably provided for driving polishing head 88 toward workpiece 54, and may be provided in the form of a 2 inch air cylinder or the like. This serves advantageously to move bricks or sanding elements 92 in and out of contact with workpiece 54 and also to apply the pressure necessary for providing polishing of workpiece 54 as desired.

Assemblies 52 and 56 can advantageously be automated so that movement up and down, rotation speed or rpm of element 62 and workpiece 54 held thereby, and the duration, sequence and/or force applied using polishing head 88 are automated so that once a workpiece 54 is mounted between elements 62, vertical motion and rotation of workpiece 54 and proper sequential operation of polishing head 88 are fully automated. This advantageously provides for uniform polishing of substantially cylindrical pieces of granite and the like, and further advantageously provides results which are duplicatable.

Still referring to FIG. 6, it may be desirable to position limit switches 98, for example on vertical support 70, for establishing upper and lower limits of movement of horizontal member 66, 68 relative to vertical support 70, 72. These can advantageously be simple limit switches communicated with a control member for the system, or can be provided in other forms as well.

A apparatus 50 in accordance with the present invention advantageously provides for polishing of the outside cylindrical surface of a substantially cylindrical-shaped piece of stone such as centerpiece portions removed in accordance with the method of the present invention as illustrated in FIGS. 1–5.

It should be appreciated that the apparatus in accordance with the present invention advantageously provides for polishing of the outside cylindrical surface of stone articles such as granite, marble and the like, and this polishing has hence forth been done by hand in an extremely time-consuming manner. Thus, the apparatus of the present invention provides significant time savings and an excellent polished quality to the outside surface of the article treated thereby.

It should also be appreciated that although portions of the above detailed description are provided in terms of treating a block of granite, the method and apparatus of the present invention are likewise applicable to other types of stone such as marble and the like.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope.

What is claimed:

1. A method for making a stone article, comprising, the steps of:

a) providing a block of material having substantially square top and bottom surfaces;

b) impacting said top and bottom surfaces with a non-square blade so as to split off excess material from said top and bottom surfaces and provide said surfaces with a shape substantially matching said non-square blade;

c) cutting a cylindrical cut into said top surface;

d) drilling a hole into said bottom surface; and e) applying a force into said hole whereby a stone portion within said cylindrical cut is removed from said block of material.

2. The method of claim 1, wherein said stone portion removed in said applying step has top and bottom surfaces, and further comprising repeating steps c, d, and e to remove a further stone portion from within said stone portion.

3. The method of claim 1, wherein said applying step is carried out using a force applying member, and further comprising positioning a shock-absorbing member between said force applying member and said block of material.

4. The method of claim 1, wherein said cylindrical cut is made from said top surface to within between about 0.5 and about 1.5 inches of said bottom surface.

5. The method of claim 1, wherein said hole is drilled to a depth of between about 0.5 and about 1.5 inches.

6. The method of claim 1, wherein said hole has a diameter of between about 0.5 and about 1 inch.

7. The method of claim 1, wherein said cylindrical cut is made in a same direction as grains of said block of material.

8. The method of claim 1, wherein said block of material is granite.

9. A method for making a stone article, comprising the steps of:

a) providing a block of material having top and bottom surfaces b) cutting a cylindrical cut into said top surface;

c) drilling a hole into said bottom surface; and d) applying a force into said hole whereby a stone portion within said cylindrical cut is removed from said block of material.

* * * * *